US006284386B1

(12) United States Patent
Jeffrey et al.

(10) Patent No.: US 6,284,386 B1
(45) Date of Patent: Sep. 4, 2001

(54) ALUMINUM ALLOY PRODUCTS WITH HIGH RESISTANCE TO PITTING CORROSION

(75) Inventors: Paul William Jeffrey, Kingston (CA); Nicholas Charles Parson, Banbury (GB); Thiagarajan Ramanan, North Royalton, OH (US); Clark Weaver, Chicoutimi (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/152,394

(22) Filed: Sep. 14, 1998

Related U.S. Application Data

(60) Provisional application No. 60/085,590, filed on May 15, 1998.

(51) Int. Cl.[7] ..... B32B 15/04

(52) U.S. Cl. ..... 428/457; 428/446; 428/450; 428/688; 420/528; 420/540; 420/548; 420/552; 420/553; 420/591

(58) Field of Search ..... 428/446, 450, 428/457, 688; 420/528, 540, 548, 552, 553, 591

(56) References Cited

U.S. PATENT DOCUMENTS

| | | | | |
|---|---|---|---|---|
| 3,859,058 | * | 1/1975 | Anthony et al. | 29/191 |
| 3,878,871 | | 4/1975 | Anthony et al. . | |

FOREIGN PATENT DOCUMENTS

| | | |
|---|---|---|
| 1 524 355 | 9/1978 | (GB) . |
| WO 97/46726 | 12/1997 | (WO) . |

* cited by examiner

*Primary Examiner*—Deborah Jones
*Assistant Examiner*—Lymarie Miranda
(74) *Attorney, Agent, or Firm*—Cooper & Dunham LLP

(57) ABSTRACT

Aluminum alloy products are described which combine both good strength and resistance to pitting corrosion. They are extruded from an aluminum alloy of the AA1000, AA3000 or AA8000 series containing about 0.001 to 0.3% zinc and about 0.001 to 0.03% titanium. The alloy may also contain 0.001 to 0.5% manganese and about 0.03 to 0.4% silicon. These products are particularly useful in the production of extruded products, such as heat exchanger tubing.

6 Claims, 2 Drawing Sheets

ALUMINUM ALLOY PRODUCTS WITH HIGH RESISTANCE TO PITTING CORROSION

CROSS REFERENCE TO RELATED APPLICATION

This application claims the benefit of U.S. Provisional Application No. 60/085,590, filed May 15, 1998.

BACKGROUND OF THE INVENTION

A difficulty with the use of aluminum alloy products in corrosive environments, such as heat exchanger tubing, is pitting corrosion. Once small pits start to form, corrosion actively concentrates in the region of the pits, so that perforation and failure of the alloy occurs much more rapidly than it would if the corrosion were more general.

Pitting corrosion is accelerated when there is a strong tendency towards surface passivation due to the growth of a corrosion resistant oxide film over the vast majority of the tube surface. However, such a film is never 100% intact due to the presence of discontinuities in the oxide, which are in some instances due to nonmetallic inclusions or intermetallics in the metal. With such a situation the passive areas are cathodic to any corrosion which may begin at the discontinuities. With such a large cathode/anode area ratio, the dissolution rate at the active sites is very rapid and the tube will perforate by pitting in 2–6 days in the SWAAT test.

Anthony et al., U.S. Pat. No. 3,878,871, issued Apr. 22, 1975, describes a corrosion resistant aluminum alloy composite material comprising an aluminum alloy core containing from 0.1 to 0.8% manganese and from 0.05 to 0.5% silicon, and a layer of cladding material which is an aluminum alloy containing 0.8 to 1.2% manganese and 0.1 to 0.4% zinc.

Sircar, WO 97/46726, published Dec. 11, 1997 describes a corrosion resistant AA 3000 series aluminum alloy containing controlled amounts of copper, zinc and titanium. It has a titanium content of 0.03 to 0.30%, but this level of titanium raises the pressures required for extrusion, which will ultimately lower productivity.

It is an object of the present invention to develop an aluminum alloy which can combine both strength and resistance to pitting corrosion. It is a further object of the invention to provide an aluminum alloy which is resistant to pitting corrosion and which is particularly useful in the production of extruded products, such as heat exchanger tubing.

It is yet another object of the invention to provide an aluminum alloy resistant to pitting corrosion which is useful in the production of sheet or plate products.

SUMMARY OF THE INVENTION

This invention relates to aluminum alloy products having high resistance to pitting corrosion which are based on AA 1000, AA 3000 and AA 8000 series of aluminum alloys. In one embodiment, they comprise extruded products in which the alloys contain about 0.001 to 0.3% zinc and about 0.001 to 0.03% titanium. In another embodiment, they comprise extruded, sheet or plate products in which the alloy contains about 0.001 to 0.5% manganese, about 0.03 to 0.4% silicon, about 0.001 to 0.3% zinc and about 0.001 to 0.03% titanium. The Zn content is preferably in the range of about 0.05 to 0.2%.

By having the titanium content below 0.03%, the alloy has improved extrudability. These alloys may be extruded to form tubing having excellent resistance to pitting corrosion or they may be rolled to form sheet or plate products also having excellent resistance to pitting corrosion.

The presence of the Zn in the above alloy is to prevent passivation of the tube or sheet surface and its associated cathodic polarization, thereby eliminating the large discrepancy in cathodic and anodic areas which also removes the large local corrosion currents and any consequential pitting. This addition of the Zn does not significantly affect the work hardening characteristics, nor the modification of existing or formation of new intermetallic compounds, and therefore the extrusion pressures and overall extrudability are unaffected.

The addition of Zn to the aluminum alloys in accordance with the present invention has been found to be especially useful when added to aluminum alloys of the AA 3000 series, in which Mn is the dominant alloying element, e.g. AA 3102 or Alcan 30015. These alloys are widely used in automotive air conditioner heat exchanger tubing. The use of Zn in the alloy according to this invention is also beneficial in aluminum alloys of the AA 1000 series as well as aluminum alloys of the AA 8000 series which are based on Fe and Cu.

BRIEF DESCRIPTION OF THE DRAWINGS

The invention is illustrated by the attached drawings in which.

DESCRIPTION OF THE PREFERRED EMBODIMENTS

EXAMPLE 1

For the purpose of illustrating the present invention, 7 inch diameter test billets were cast from different 3000 series aluminum alloys, with and without the addition of Zn. The alloys used are described in Table 1.

The casts MGL and MGM are comparative casts with a higher Ti content in the range shown in WO 97/46726.

Figure 1:
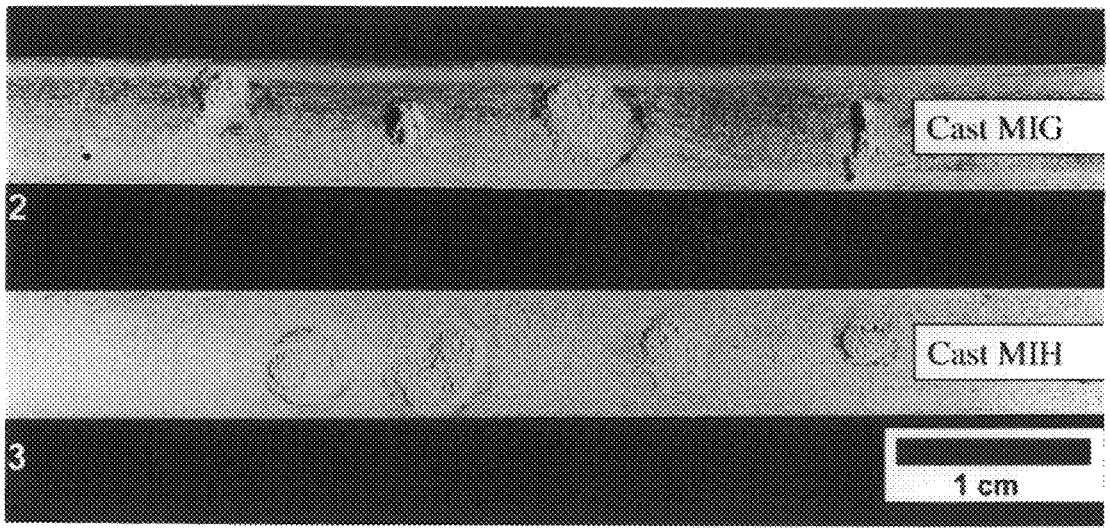
FIG. 1 is a photograph of two samples of the invention in 20 day SWAAT tests.
Figure 2:
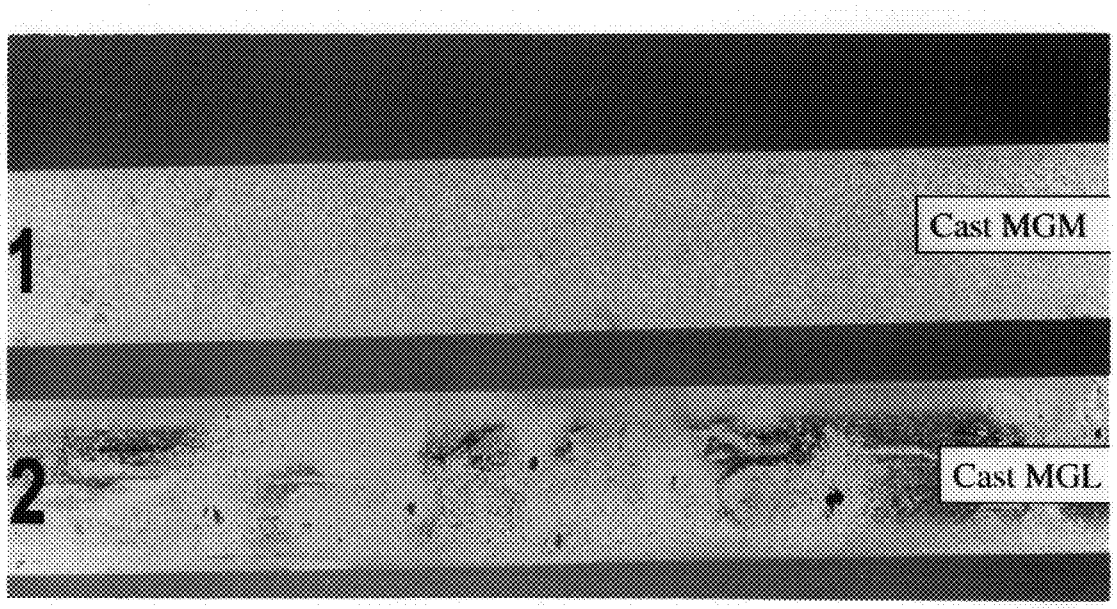
FIG. 2 is a photograph of two comparative samples after a 20 day SWAAT test.

The billets were homogenized for four hours at 580° C., machined to 4 inches diameter to allow fitting into a laboratory press and extruded to form tubing having a diameter of 0.25 inch and a wall thickness of 0.016 inch. The tubes were then SWAAT tested for 20 days in order to rate their resistance to pitting corrosion. The results obtained are shown in FIGS. 1 and 2, with FIG. 1 showing the results for casts MIG and MIH and FIG. 2 showing the results for comparative casts MGM and MGL. These clearly illustrate the very significant improvement in pitting corrosion due to the addition of Zn to the alloy. Casts MIG and MGL with low Zn contents both exhibit large pits in the tube which fully penetrate the wall. The results also show that this improvement is achieved independent of whether or not an addition of 0.16% Ti is present.

TABLE 1

| Cast Number | Cu | Fe | Mg | Mn | Ni | Si | Ti | Zn | Cr | Pb | Sn | B | Ga | V |
|---|---|---|---|---|---|---|---|---|---|---|---|---|---|---|
| MIG | 0.0027 | 0.4625 | 0 | 0.1107 | 0.0016 | 0.083 | 0.0089 | 0.0022 | 0.0003 | 0.0012 | 0 | 0.0012 | 0.0089 | 0.0046 |
| MIH | 0.0027 | 0.4597 | 0 | 0.1101 | 0.0016 | 0.0792 | 0.0088 | 0.1658 | 0.0003 | 0.0012 | 0 | 0.0012 | 0.0091 | 0.0046 |
| MGL | 0.0026 | 0.0651 | 0 | 0.2475 | 0.0015 | 0.0625 | 0.1565 | 0.0025 | 0.0002 | 0.0031 | 0 | 0.0014 | 0.0113 | 0.0099 |
| MGM | 0.0024 | 0.0684 | 0 | 0.2481 | 0.0014 | 0.0629 | 0.1607 | 0.1612 | 0.0002 | 0.0032 | 0 | 0.0014 | 0.0015 | 0.0102 |

EXAMPLE 2

Following the same procedure as described in Example 1, a series of sample tubes were prepared using five different aluminum alloys having zinc contents ranging from 0.0017% to 0.2430%. The alloys used and the results obtained are described in Table 2.

TABLE 2

| Cast Number | Fe | Cu | Mn | Si | Zn | Perforation during 40 day SWAAT test? |
|---|---|---|---|---|---|---|
| MKJ | 0.409 | 0.0013 | 0.234 | 0.074 | 0.0017 | Yes (2/12) |
| MKK | 0.406 | 0.0013 | 0.234 | 0.073 | 0.0211 | No |
| MKL | 0.419 | 0.0013 | 0.235 | 0.074 | 0.0769 | No |
| MKM | 0.425 | 0.0013 | 0.233 | 0.076 | 0.1520 | No |
| MKN | 0.428 | 0.0013 | 0.236 | 0.074 | 0.2430 | No |

What is claimed is:

1. An aluminum alloy extruded product consisting essentially of an aluminum alloy of the AA 1000, AA 3000 or AA 8000 series containing about 0.05 to 0.3% zinc and about 0.001 to 0.03% titanium.

2. An aluminum alloy extruded product according to claim 1 which contains about 0.001 to 0.5% manganese and about 0.03 to 0.4% silicon.

3. An aluminum alloy extruded product according to claim 2 wherein the zinc is present in an amount of about 0.05 to 0.2%.

4. An aluminum alloy extruded product according to claim 1 comprising an extruded heat exchanger tube.

5. An aluminum alloy extrusion, sheet or plate product consisting essentially of an aluminum alloy of the AA 1000, AA 3000 or AA 8000 series containing about 0.001 to 0.5% manganese, about 0.03 to 0.4% silicon, about 0.05 to 0.3% zinc and about 0.001 to 0.03% titanium.

6. An aluminum alloy product according to claim 5 wherein the zinc is present in an amount of about 0.05 to 0.2%.

* * * * *